US012060694B2

(12) United States Patent
Ishihara et al.

(10) Patent No.: US 12,060,694 B2
(45) Date of Patent: Aug. 13, 2024

(54) BLADE CONTROL DEVICE AND BLADE CONTROL METHOD

(71) Applicant: Komatsu Ltd., Tokyo (JP)

(72) Inventors: Takao Ishihara, Tokyo (JP); Daichi Noborio, Tokyo (JP); Yutaka Nakayama, Tokyo (JP)

(73) Assignee: Komatsu Ltd., Tokyo (JP)

( * ) Notice: Subject to any disclaimer, the term of this patent is extended or adjusted under 35 U.S.C. 154(b) by 962 days.

(21) Appl. No.: 17/047,781

(22) PCT Filed: Jan. 29, 2019

(86) PCT No.: PCT/JP2019/003026

§ 371 (c)(1),
(2) Date: Oct. 15, 2020

(87) PCT Pub. No.: WO2019/230045

PCT Pub. Date: Dec. 5, 2019

(65) Prior Publication Data

US 2021/0156111 A1 May 27, 2021

(30) Foreign Application Priority Data

May 31, 2018 (JP) ..... 2018-105661

(51) Int. Cl.
*E02F 3/84* (2006.01)
*E02F 3/76* (2006.01)

(52) U.S. Cl.
CPC ..... *E02F 3/845* (2013.01); *E02F 3/7609* (2013.01)

(58) Field of Classification Search
CPC ..... E02F 3/7609
See application file for complete search history.

(56) References Cited

U.S. PATENT DOCUMENTS 5,769,168 A 6/1998 Skiba
5,950,141 A 9/1999 Yamamoto et al.
(Continued)

FOREIGN PATENT DOCUMENTS

JP H09-209393 A 8/1997
JP H10-88611 A 4/1998
(Continued)

OTHER PUBLICATIONS

International Search Report mailed Apr. 10, 2019, issued for PCT/JP2019/003026.

*Primary Examiner* — Dale Moyer
(74) *Attorney, Agent, or Firm* — Locke Lord LLP

(57) ABSTRACT

A blade control method includes: acquiring a design surface indicating a target shape of an excavation object to be excavated by a blade supported by a vehicle body of a work vehicle, the design surface including a first surface present in front of the work vehicle and a second surface disposed below the first surface and forming a level difference with a front end portion of the first surface; acquiring an observed pitch angle indicating an inclination angle of the vehicle body in a longitudinal direction; and calculating a specific part height indicating a height-direction distance between a specific part of the work vehicle and the second surface in a state in which at least a part of the vehicle body is positioned on the first surface and the blade is positioned above the second surface.

7 Claims, 9 Drawing Sheets

(56) References Cited

U.S. PATENT DOCUMENTS

| | | | | |
|---|---|---|---|---|
| 9,328,479 | B1 | 5/2016 | Rausch et al. | |
| 2011/0196585 | A1* | 8/2011 | Ishibashi | E02F 9/2253 180/6.48 |
| 2014/0180547 | A1* | 6/2014 | Edara | G05D 1/0278 701/50 |
| 2015/0019086 | A1* | 1/2015 | Hayashi | E02F 3/844 172/4 |
| 2016/0122969 | A1* | 5/2016 | Noborio | E02F 9/262 701/50 |

FOREIGN PATENT DOCUMENTS

| | | | |
|---|---|---|---|
| JP | 2010-255292 | A | 11/2010 |
| JP | 2014-84683 | A | 5/2014 |
| WO | 15/083469 | A1 | 6/2015 |

* cited by examiner

[ESTIMATION TABLE]

[CORRECTION TABLE]

BLADE CONTROL DEVICE AND BLADE CONTROL METHOD

FIELD

The present invention relates to a blade control device and a blade control method.

BACKGROUND

A work vehicle having a blade is used for excavation of an excavation object or for leveling. A work vehicle that causes a blade to follow a design surface has been proposed. The design surface refers to a target shape of the excavation object.

CITATION LIST

Patent Literature

Patent Literature 1: International Publication No. WO 2015/083469

SUMMARY

Technical Problem

The blade is driven by a hydraulic system. The hydraulic system is driven based on a control command output from a blade control device. The design surface may be composed of a plurality of surfaces having different slopes. If a control delay occurs when the blade passes a boundary between surfaces having different slopes, the blade may fail to follow the design surface. As a result, the blade may excavate the excavation object beyond the design surface, and the excavation object may not be excavated into a desired shape.

It is an object of an aspect of the present invention to excavate the excavation object into a desired shape.

Solution to Problem

According to an aspect of the present invention, a blade control device comprises: a design surface acquisition unit that acquires a design surface indicating a target shape of an excavation object to be excavated by a blade supported by a vehicle body of a work vehicle, the design surface including a first surface present in front of the work vehicle and a second surface disposed below the first surface and forming a level difference with a front end portion of the first surface; a vehicle body angle acquisition unit that acquires an observed pitch angle indicating an inclination angle of the vehicle body in a longitudinal direction; a specific part height calculation unit that, in a state in which at least a part of the vehicle body is positioned on the first surface and the blade is positioned above the second surface, calculates a specific part height indicating a height-direction distance between a specific part of the work vehicle and the second surface; a corrected pitch angle calculation unit that corrects the observed pitch angle based on the specific part height and calculates a corrected pitch angle of the vehicle body; and a target cylinder speed calculation unit that, based on the corrected pitch angle, calculates a target cylinder speed of a hydraulic cylinder that adjusts a height of the blade.

Advantageous Effects of Invention

According to an aspect of the present invention, the excavation object can be excavated into a desired shape.

DESCRIPTION OF EMBODIMENTS

Figure 1:
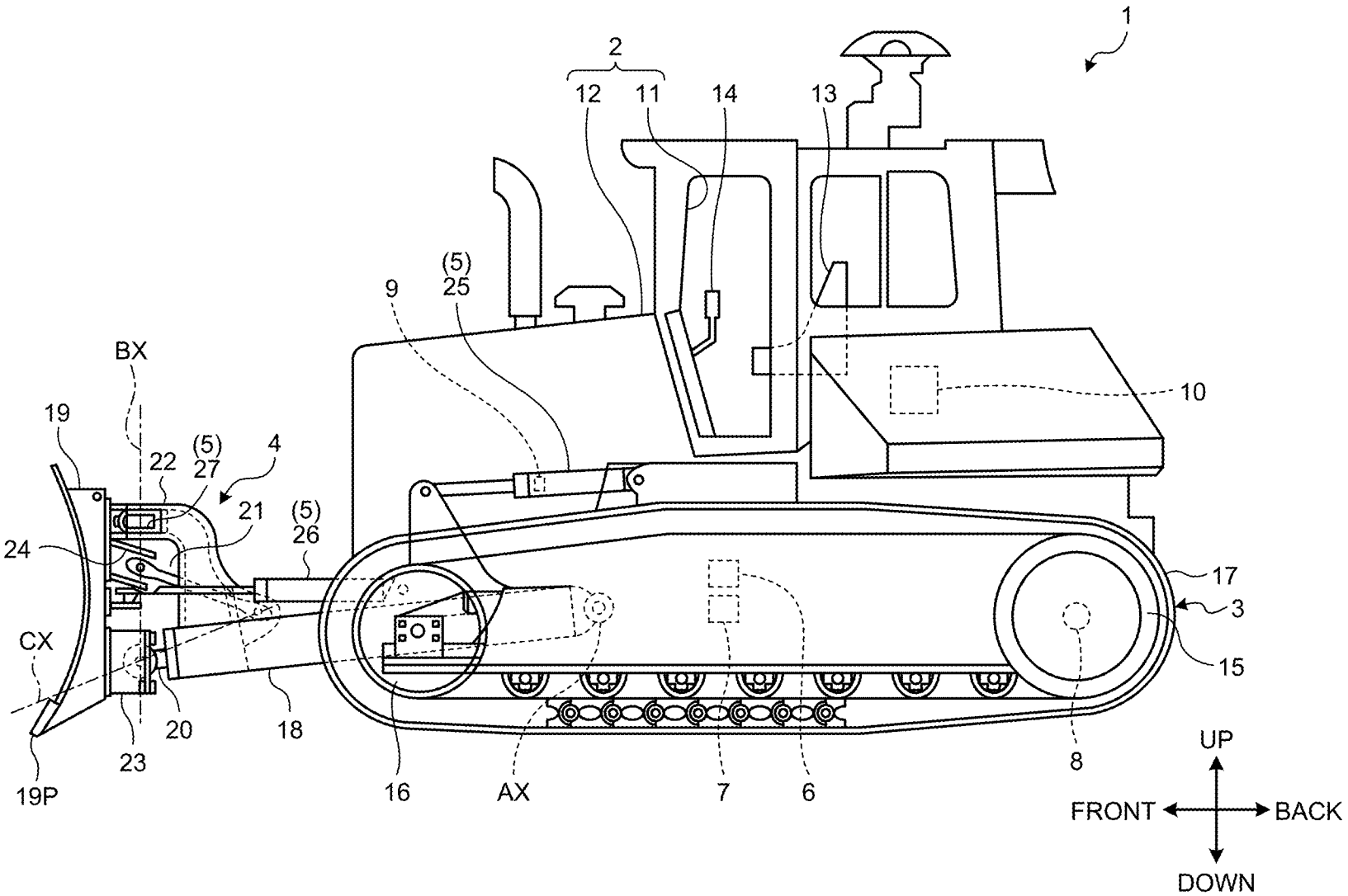
FIG. 1 is a view illustrating a work vehicle according to the present embodiment.

Hereinafter, embodiments according to the present invention will be described with reference to the drawings; however, the present invention is not limited thereto. Components of the embodiments to be described below can be appropriately combined with one another. In some cases, some components are not used.

In the following description, a global coordinate system and a local coordinate system are defined, and positional relationships between respective portions will be described. The global coordinate system refers to a coordinate system that takes as a reference an origin fixed to the earth. The global coordinate system is a coordinate system defined by a global navigation satellite system (GNSS). The GNSS is a global navigation satellite system. As an example of the global navigation satellite system, mentioned is a global positioning system (GPS). The GNSS includes a plurality of positioning satellites. The GNSS detects a position defined by coordinate data of latitude, longitude, and altitude. The local coordinate system refers to a coordinate system that takes as a reference an origin fixed to a vehicle body 2 of a work vehicle 1. In the local coordinate system, the vertical direction, the horizontal direction, and the longitudinal direction are defined. As will be described later, the work vehicle 1 includes the vehicle body 2 provided with a seat 13 and an operation device 14, and travel devices 3 each of which includes a drive wheel 15 and a crawler belt 17. The vertical direction refers to a direction perpendicular to a ground contact surface of the crawler belt 17. The vertical direction is synonymous with a vehicle width direction of the work vehicle 1. The horizontal direction is a direction parallel to a rotation axis of the drive wheel 15. The horizontal direction is synonymous with a vehicle width direction of the work vehicle 1. The longitudinal direction is a direction perpendicular to the horizontal direction and the vertical direction.

An upper side refers to one direction in the vertical direction, and refers to a direction away from the ground contact surface of the crawler belt 17. A lower side refers to a direction opposite to the upper side in the vertical direction, and refers to a direction approaching the ground contact surface of the crawler belt 17. A left side refers to one direction in the horizontal direction, and refers to a left side direction while taking as a reference an operator of the work vehicle 1, who is seated on the seat 13 so as to face the operation device 14. A right side refers to a direction opposite to the left side in the horizontal direction, and refers to a right-side direction while taking as a reference the operator of the work vehicle 1, who is seated on the seat 13. A front side refers to one direction in the longitudinal direction, and refers to a direction from the seat 13 toward the operation device 14. A rear side refers to a direction opposite to the front side in the longitudinal direction, and refers to a direction from the operation device 14 toward the seat 13.

Moreover, an upper portion refers to an upper side portion of a member or a space in the vertical direction, and refers to a portion separated from the ground contact surface of the crawler belt 17. A lower portion refers to a lower side portion of the member or the space in the vertical direction, and refers to a portion close to the ground contact surface of the crawler belt 17. A left portion refers to a left side portion of the member or the space when the operator of the work vehicle 1, who is seated on the seat 13, is taken as a reference. A right portion refers to a right-side portion of the member or the space when the operator of the work vehicle 1, who is seated on the seat 13, is taken as a reference. A front portion refers to a portion on a front side of the member or the space in the longitudinal direction. A rear portion refers to a portion on a rear side of the member or the space in the longitudinal direction.

[Work Vehicle]

Figure 2:
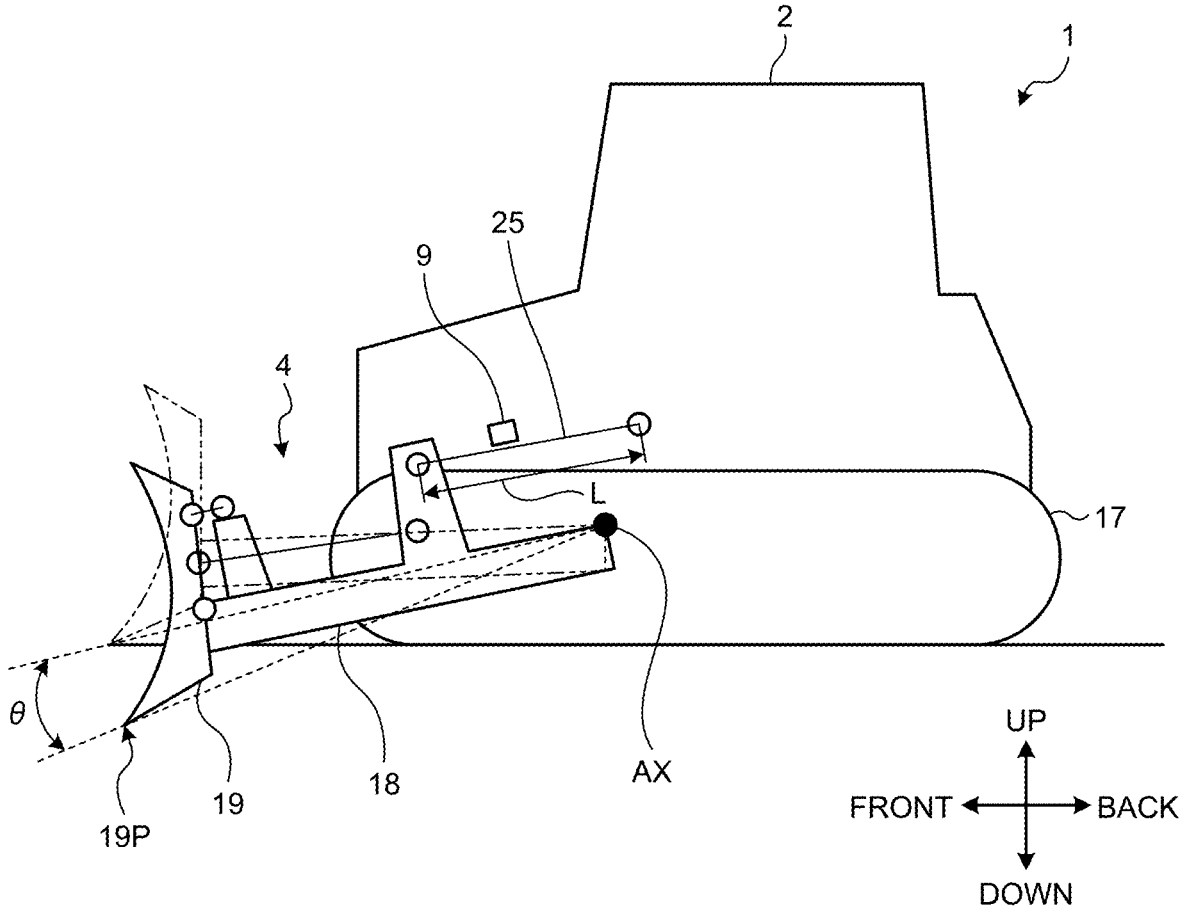
FIG. 2 is a view schematically illustrating the work vehicle according to the present embodiment.

FIG. 1 is a view illustrating the work vehicle 1 according to the present embodiment. FIG. 2 is a view schematically illustrating the work vehicle 1 according to the present embodiment. In the present embodiment, the work vehicle 1 is defined as a bulldozer. The work vehicle 1 includes the vehicle body 2, the travel devices 3, working equipment 4, a hydraulic cylinder 5, a position sensor 6, an inclination sensor 7, a speed sensor 8, an operation amount sensor 9, and a blade control device 10.

The vehicle body 2 includes an operator's cab 11 and an engine compartment 12. The engine compartment 12 is disposed in front of the operator's cab 11. In the operator's cab 11, the seat 13 on which an operator is seated and the operation device 14 operated by the operator are disposed. The operation device 14 includes an operation lever for operating the working equipment 4 and a travel lever for operating the travel device 3.

The travel devices 3 support the vehicle body 2. Each of the travel devices 3 includes the drive wheel 15 called a sprocket, an idler wheel 16 called an idler, and the crawler belt 17 supported by the drive wheel 15 and the idler wheel 16. The idler wheel 16 is disposed in front of the drive wheel 15. The drive wheel 15 is driven by power generated by a drive source such as a hydraulic motor. The drive wheel 15 is rotated by operating the travel lever of the operation device 14. The work vehicle 1 travels in such a manner that the drive wheel 15 is rotated to rotate the crawler belt 17.

The working equipment 4 is movably supported by the vehicle body 2. The working equipment 4 includes a lift frame 18 and a blade 19.

The lift frame 18 is supported by the vehicle body 2 so as to be vertically rotatable about a rotation axis AX extending in the vehicle width direction. The lift frame 18 supports the blade 19 via a ball joint portion 20, a pitch support link 21, and a support portion 22.

The blade 19 is disposed in front of the vehicle body 2. The blade 19 includes a universal joint 23 that contacts the ball joint portion 20, and a pitching joint 24 that contacts the pitch support link 21. The blade 19 is movably supported by the vehicle body 2 via the lift frame 18. The blade 19 moves in the vertical direction in conjunction with a vertical rotational movement of the lift frame 18.

The blade 19 has a cutting edge 19P. The cutting edge 19P is disposed at a lower end of the blade 19. In excavation work or leveling work, the cutting edge 19P excavates an excavation object.

The hydraulic cylinder 5 generates power to move the working equipment 4. The hydraulic cylinder 5 includes a lift cylinder 25, an angle cylinder 26, and a tilt cylinder 27.

The lift cylinder 25 is a hydraulic cylinder 5 able to move the blade 19 in the vertical direction (lift direction). The lift cylinder 25 is able to adjust a height of the blade 19, which indicates a position of the blade 19 in the vertical direction. The lift cylinder 25 is coupled to each of the vehicle body 2 and the lift frame 18. The lift cylinder 25 expands and contracts, whereby the lift frame 18 and the blade 19 move in the vertical direction about the rotation axis AX.

The angle cylinder 26 is the hydraulic cylinder 5 able to move the blade 19 in a rotation direction (angle direction). The angle cylinder 26 is coupled to each of the lift frame 18 and the blade 19. The angle cylinder 26 expands and contracts, whereby the blade 19 rotates about a rotation axis BX. The rotation axis BX passes through a rotation axis of the universal joint 23 and a rotation axis of the pitching joint 24.

The tilt cylinder 27 is the hydraulic cylinder 5 able to move the blade 19 in a rotation direction (tilt direction). The tilt cylinder 27 is coupled to the support portion 22 of the lift frame 18 and an upper right end of the blade 19. The tilt cylinder 27 expands and contracts, whereby the blade 19 rotates about a rotation axis CX. The rotation axis CX passes through the ball joint portion 20 and a lower end of the pitch support link 21.

The position sensor 6 detects a position of the vehicle body 2 of the work vehicle 1. The position sensor 6 includes a GPS receiver, and detects a position of the vehicle body 2 in the global coordinate system. Detection data of the position sensor 6 includes vehicle body position data indicating an absolute position of the vehicle body 2.

The inclination sensor 7 detects an inclination angle of the vehicle body 2 with respect to a horizontal plane. The detection data of the inclination sensor 7 includes the vehicle body angle data indicating the inclination angle of the vehicle body 2. The inclination sensor 7 includes an inertial measurement unit (IMU).

The speed sensor 8 detects a travel speed of the travel device 3. Detection data of the speed sensor 8 includes travel speed data indicating the travel speed of the travel device 3.

The operation amount sensor 9 detects an operation amount of the hydraulic cylinder 5. The operation amount of the hydraulic cylinder 5 includes a stroke length of the hydraulic cylinder 5. Detection data of the operation amount sensor 9 includes operation amount data indicating the operation amount of the hydraulic cylinder 5. The operation amount sensor 9 includes a rotating roller that detects a position of a rod of the hydraulic cylinder 5, and a magnetic force sensor that returns the position of the rod to an origin thereof. The operation amount sensor 9 may be an angle sensor that detects an inclination angle of the working equipment 4. Moreover, the operation amount sensor 9 may be an angle sensor that detects a rotation angle of the hydraulic cylinder 5.

The operation amount sensor 9 is provided in each of the lift cylinder 25, the angle cylinder 26, and the tilt cylinder 27. The operation amount sensor 9 detects a stroke length of the lift cylinder 25, a stroke length of the angle cylinder 26, and a stroke length of the tilt cylinder 27.

As illustrated in FIG. 2, the lift angle θ of the blade 19 is calculated based on the stroke length L of the lift cylinder 25. The lift angle θ refers to a descending angle of the blade 19 from an initial position of the working equipment 4. As indicated by a chain double-dashed line in FIG. 2, the initial position of the working equipment 4 refers to a position of the working equipment 4 when the cutting edge 19P of the blade 19 contacts a predetermined surface parallel to the ground contact surface of the crawler belt 17. The lift angle θ corresponds to a distance (penetration depth) between the predetermined surface and the cutting edge 19P disposed below the predetermined surface. The work vehicle 1 moves forward in a state in which the cutting edge 19P of the blade 19 is disposed below the predetermined surface, whereby the excavation work or the leveling work by the blade 19 is implemented.

[Blade Control Device]

Figure 3:
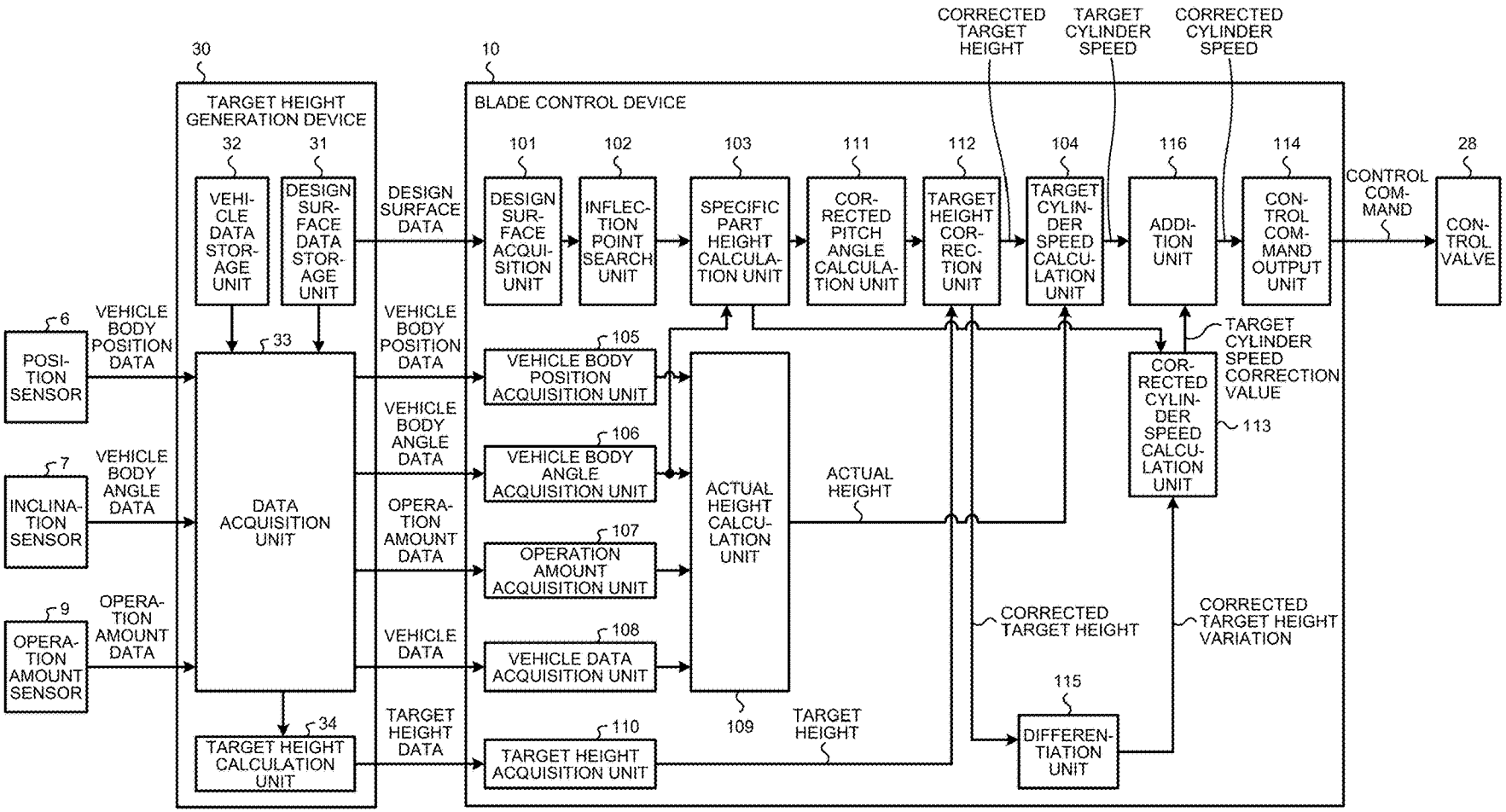
FIG. 3 is a functional block diagram illustrating a blade control device according to the present embodiment.

FIG. 3 is a functional block diagram illustrating the blade control device 10 according to the present embodiment. The blade control device 10 includes a computer system. A target height generation device 30 is connected to the blade control device 10. The target height generation device 30 includes a computer system.

The blade control device 10 controls the height of the cutting edge 19P of the blade 19. The blade control device 10 controls the height of the cutting edge 19P by controlling the lift cylinder 25 able to move the blade 19 in the vertical direction.

The work vehicle 1 includes a control valve 28 that controls a flow rate and direction of the hydraulic oil supplied to the lift cylinder 25. The blade control device 10 controls the height of the cutting edge 19P by controlling the control valve 28.

The control valve 28 includes a proportional control valve. The control valve 28 is disposed in an oil passage between the lift cylinder 25 and a hydraulic pump (not illustrated) that discharges hydraulic oil for driving the blade 19. The hydraulic pump supplies the hydraulic oil to the lift cylinder 25 via the control valve 28. The lift cylinder 25 is driven based on the hydraulic oil controlled by the control valve 28.

The target height generation device 30 generates target height data, which indicates the target height of the cutting edge 19P of the blade 19, based on a design surface IS indicating a target shape of the excavation object. The target height of the cutting edge 19P refers to a position of the cutting edge 19P, where the cutting edge 19P can be matched with the design surface IS in the local coordinate system.

<Target Height Generation Device>

The target height generation device 30 includes a design surface data storage unit 31, a vehicle data storage unit 32, a data acquisition unit 33, and a target height calculation unit 34.

The design surface data storage unit 31 stores design surface data indicating the design surface IS that is the target shape of the excavation object to be excavated by the blade 19. The design surface IS includes three-dimensional shape data indicating the target shape of the excavation object. The design surface IS includes computer aided design (CAD) data created, for example, based on the target shape of the excavation object, and is stored in the design surface data storage unit 31 in advance.

The design surface data may be transmitted from the outside of the work vehicle 1 to the target height generation device 30 via a communication line.

The vehicle data storage unit 32 stores vehicle data indicating dimensions and shape of the work vehicle 1. The dimensions of the work vehicle 1 include dimensions of the lift frame 18 and dimensions of the blade 19. The shape of the work vehicle 1 includes the shape of the blade 19. The vehicle data is known data derivable from design data or specification data of the work vehicle 1, and is stored in the vehicle data storage unit 32 in advance.

The data acquisition unit 33 acquires vehicle body position data, which indicates the absolute position of the vehicle body 2, from the position sensor 6. The data acquisition unit 33 acquires vehicle body angle data, which indicates the inclination angle of the vehicle body 2, from the inclination sensor 7. The data acquisition unit 33 acquires the operation amount data, which indicates the stroke length of the lift cylinder 25, from the operation amount sensor 9.

The data acquisition unit 33 acquires the design surface data, which indicating the design surface IS, from the design surface data storage unit 31. The data acquisition unit 33 acquires the vehicle data, which indicates the dimensions and shape of the work vehicle 1, from the vehicle data storage unit 32.

The target height calculation unit 34 calculates the target height of the cutting edge 19P based on the vehicle body position data, the vehicle body angle data, the operation amount data, the vehicle data, and the design surface data.

Figure 4:
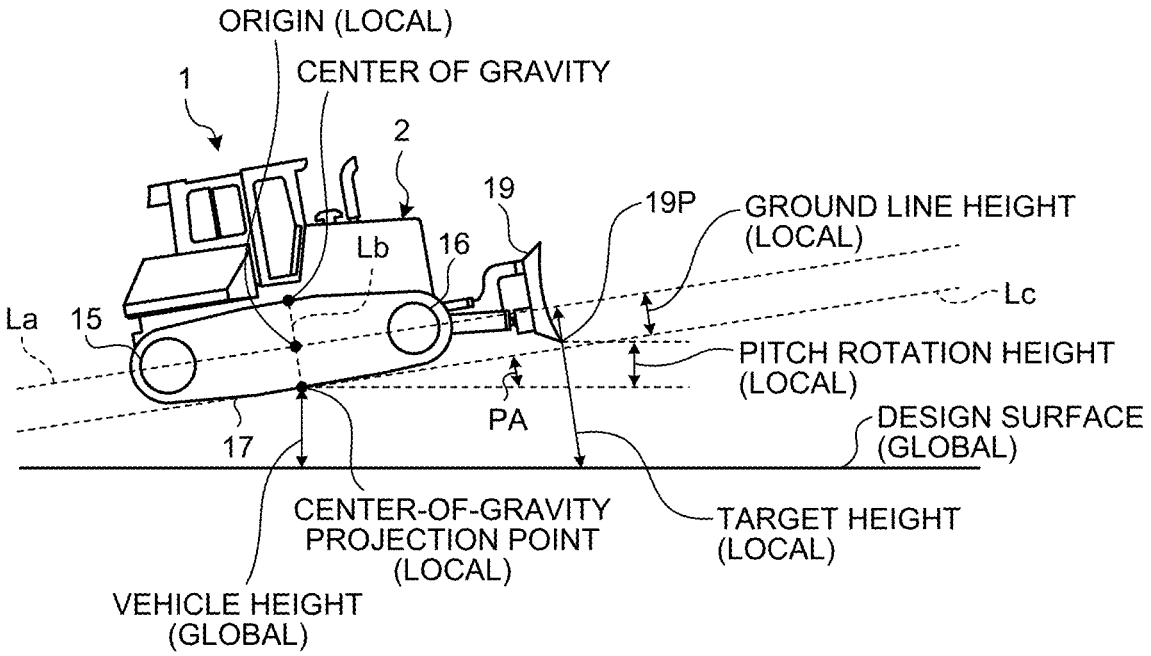
FIG. 4 is a view for explaining calculation processing of a target height by a target height calculation unit according to the present embodiment.

FIG. 4 is a view for explaining calculation processing of the target height by the target height calculation unit 34 according to the present embodiment. The design surface IS is defined in the global coordinate system. The target height of the cutting edge 19P is specified in the local coordinate system.

As illustrated in FIG. 4, the origin of the local coordinate system is defined on a line La that passes through the rotation axis of the idler wheel 16 and extends in the longitudinal direction. The origin of the local coordinate system is the intersection of the line La and a perpendicular Lb that passes through the center of gravity of the vehicle body 2 and is perpendicular to the line La. Further, the position sensor 6 detects a vehicle body height indicating a height of the vehicle body 2 in the global coordinate system. In the present embodiment, the vehicle body height is a height of a center-of-gravity projection point indicating an intersection of a line Lb and the ground contact surface of the crawler belt 17. A line Lc that passes through the center-of-gravity projection point and extends in the longitudinal direction is defined.

The vehicle body height is calculated based on the vehicle data and the vehicle body position data detected by the position sensor 6. A ground line height is defined in the local coordinate system. The ground line height refers to a distance between the line La and the line Lc in the vertical direction of the local coordinate system.

When the lift cylinder 25 is driven, the position of the cutting edge 19P changes in conjunction with the drive of the lift cylinder 25. Further, when the vehicle body 2 inclines, the position of the cutting edge 19P changes in conjunction with the inclination of the vehicle body 2. A pitch rotation height is defined in the local coordinate system. The pitch rotation height refers to a height of the cutting edge 19P, which changes in conjunction with the inclination of the vehicle body 2. When the inclination angle of the vehicle body 2 in the longitudinal direction is a pitch angle PA, and a distance between the cutting edge 19P and the center-of-gravity projection point in the longitudinal direction is W, the pitch rotation height is represented by [W×sin(PA)].

The target height is represented by a length of a line segment that is perpendicular to the line La, passes through the cutting edge 19P, and intersects the design surface. In the present embodiment, the target height is approximately represented as the sum of the vehicle body height, the ground line height, and the pitch rotation height.

As described above, the target height calculation unit 34 calculates the target height of the cutting edge 19P based on the vehicle body position data, the vehicle body angle data including the pitch angle PA, the vehicle data, the operation amount data, and the design surface data.

The pitch angle PA, which indicates the inclination angle of the vehicle body 2 in the longitudinal direction, is detected by the inclination sensor 7. In the following description, the inclination angle of the vehicle body 2 in the longitudinal direction, which is detected by the inclination sensor 7, is appropriately referred to as an observed pitch angle PA. The inclination sensor 7 can also detect an inclination angle of the vehicle body 2 in the vehicle width direction.

<Blade Control Device>

The blade control device 10 includes a design surface acquisition unit 101, an inflection position search unit 102, a specific part height calculation unit 103, a target cylinder speed calculation unit 104, a vehicle body position acquisition unit 105, and a vehicle body angle acquisition unit 106, an operation amount acquisition unit 107, a vehicle data acquisition unit 108, an actual height calculation unit 109, a target height acquisition unit 110, a corrected pitch angle calculation unit 111, a target height correction unit 112, a differentiation unit 115, a corrected cylinder speed calculation unit 113, an addition unit 116, and a control command output unit 114.

The design surface acquisition unit 101 acquires the design surface data, which indicating the design surface IS, from the design surface data storage unit 31.

The inflection position search unit 102 searches for an inflection position CP indicating a front end portion of the first surface F1, which is present in front of the work vehicle 1 on the design surface IS.

Figure 5:
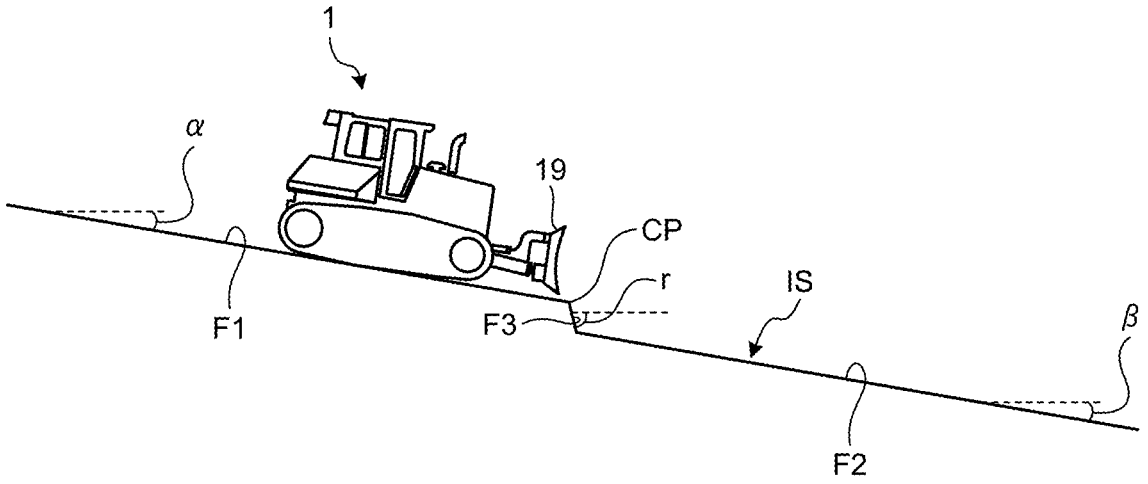
FIG. 5 is a view schematically illustrating a design surface according to the present embodiment.

FIG. 5 is a view schematically illustrating the design surface IS according to the present embodiment. The design surface IS may be composed of a plurality of surfaces having different slopes. In the example illustrated in FIG. 5, the design surface IS includes the first surface F1 present in front of the work vehicle 1, and a second surface F2 disposed below the first surface F1 and forming a level difference with the front end portion of the first surface F1. The first surface F1 of the design surface IS is present in front of the work vehicle 1, and the second surface F2 is present in front of the first surface F1. The front end portion of the first surface F1 and a rear end portion of the second surface F2 are connected to each other by a third surface F3. An upper end portion of the third surface F3 and the front end portion of the first surface F1 are connected to each other. A corner portion is formed by the first surface F1 and the third surface F3. A lower end of the third surface F3 and the rear end portion of the second surface F2 are connected to each other. The inflection position CP includes a boundary between the front end portion of the first surface F1 and the upper end portion of the third surface.

In the present embodiment, the level difference refers to a shape in which a specific part of the crawler belt 17 of the work vehicle 1 that travels from the first surface F1 toward the second surface F2 does not contact the third surface F3 when the first surface F1 and the second surface F2 are connected to each other via the third surface F3. A dimension of the third surface F3 in the vertical direction is shorter than a dimension of the ground contact surface of the crawler belt 17 in the longitudinal direction.

A slope of the first surface F1 and a slope of the third surface F3 are different from each other. A slope of the second surface F2 and the slope of the third surface F3 are different from each other. An inclination angle $\alpha$ of the first surface F1 with respect to the horizontal plane is smaller than an inclination angle $\gamma$ of the third surface F3 with respect to the horizontal plane. An inclination angle $\beta$ of the second surface F2 with respect to the horizontal plane is smaller than the inclination angle $\gamma$ of the third surface F3 with respect to the horizontal plane. An inclination angle $\alpha$ of the first surface F1 with respect to the horizontal plane may be the same as or different from the inclination angle $\beta$ of the second surface F2 with respect to the horizontal plane.

In the example illustrated in FIG. 5, the first surface F1 is inclined downward toward the front of the work vehicle 1. The second surface F2 is inclined downward toward the front of the work vehicle 1. At least one of the first surface F1 and the second surface F2 may be inclined upward toward the front of the work vehicle 1. The front end portion of the first surface F1 just needs to be located above the rear end portion of the second surface F2.

The inflection position search unit 102 can search for the inflection position CP, which indicates the front end portion of the first surface F1, based on the design surface data acquired by the design surface acquisition unit 101. The inflection position search unit 102 can identify the inflection position CP and whether or not the level difference is present, for example, based on a relationship between the inclination angle $\alpha$, the inclination angle $\gamma$, and the inclination angle $\beta$, the relationship being derived from the design surface data. The inflection position search unit 102 may identify the inflection position CP and whether or not the level difference is present based on a relative position between the front end portion of the first surface F1 and the rear end portion of the second surface F2.

The inflection position search unit 102 may search for the inflection position CP in a two-dimensional plane or may search for the inflection position CP in a three-dimensional space. When searching for the inflection position CP in the two-dimensional plane, the inflection position search unit 102 searches for an intersection of the first surface F1 and the third surface F3 on an intersection line of the design surface IS and a surface passing through the cutting edge 19P and extending in the longitudinal direction in the local coordinate system, and can thereby specify the inflection position CP. When searching for the inflection position CP in the three-dimensional space, the inflection position search unit 102 can specify the inflection position CP based on a state of change of height data of the design surface IS, which is present in front of the vehicle body 2, with respect to the vehicle body 2.

In the following description, an inclination angle β of the second surface F2 with respect to the horizontal plane will be appropriately referred to as a design surface pitch angle β. The inflection position search unit 102 can specify the position of the inflection position CP and the design surface pitch angle β of the second surface F2 based on the design surface data acquired by the design surface acquisition unit 101.

The vehicle body position acquisition unit 105 acquires the vehicle body position data, which indicates the position of the vehicle body 2, from the data acquisition unit 33.

The vehicle body angle acquisition unit 106 acquires the vehicle body angle data, which indicates the inclination angle of the vehicle body 2, from the data acquisition unit 33. As mentioned above, the inclination angle of the vehicle body 2 includes the observed pitch angle PA indicating the inclination angle of the vehicle body 2 in the longitudinal direction. The vehicle body angle acquisition unit 106 acquires the observed pitch angle PA of the vehicle body 2, which is detected by the inclination sensor 7, from the data acquisition unit 33.

The operation amount acquisition unit 107 acquires the operation amount data, which indicates the operation amount of the lift cylinder 25 able to move the blade 19, from the data acquisition unit 33.

The vehicle data acquisition unit 108 acquires the vehicle data, which indicates the dimensions and shape of the work vehicle 1, from the data acquisition unit 33.

The actual height calculation unit 109 calculates an actual height, which indicates an actual height of the cutting edge 19P of the blade 19 in the local coordinate system, based on the vehicle body position data, the vehicle body angle data, the operation amount data, and the vehicle data.

The actual height calculation unit 109 calculates the lift angle θ of the blade 19 based on the operation amount data. The actual height calculation unit 109 calculates the height of the cutting edge 19P of the blade 19 in the local coordinate system based on the lift angle θ and the vehicle data. Further, the actual height calculation unit 109 can calculate the height of the cutting edge 19P of the blade 19 in the global coordinate system based on the origin of the local coordinate system and the vehicle body position data.

The target height acquisition unit 110 acquires a target height of the cutting edge 19P of the blade 19, which is calculated based on the design surface IS in the target height calculation unit 34, from the target height calculation unit 34.

The specific part height calculation unit 103 calculates a specific part height Ha indicating a height-direction (vertical-direction) distance between such a specific part SP of the ground contact surface of the crawler belt 17 of the work vehicle 1 and the second surface F2 in a state in which at least a part of the vehicle body 2 is positioned on the first surface F1 and the blade 19 is positioned above the second surface F2.

Figure 6:
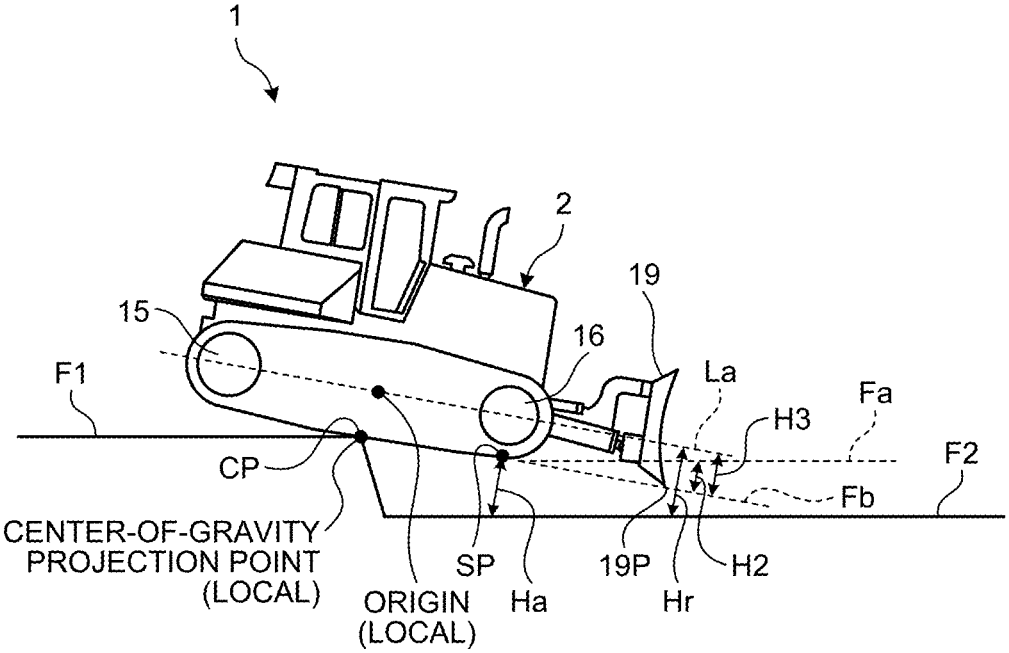
FIG. 6 is a view for explaining a specific part height according to the present embodiment.

FIG. 6 is a view for explaining the specific part height Ha according to the present embodiment. As illustrated in FIG. 6, the specific part height Ha refers to a vertical-direction distance between the second surface F2 and the specific part SP defined on the ground contact surface of the crawler belt 17 in the local coordinate system.

The work vehicle 1 includes the idler wheels 16 which are front wheels, the drive wheels 15 which are rear wheels, and the crawler belts 17 supported by the idler wheels 16 and the drive wheels 15. In the present embodiment, the specific part SP is defined in a front portion of the ground contact surface of each of the crawler belts 17. More specifically, the specific part SP is defined on the ground contact surface of the crawler belt 17 immediately below the rotation axis of the idler wheel 16. The specific part SP may be defined at a position different from the ground contact surface of the crawler belt 17 immediately below the rotation axis of the idler wheel 16.

The specific part height calculation unit 103 calculates the specific part height Ha based on the inflection position CP. For example, when the work vehicle 1 moves forward on the first surface F1 and the center-of-gravity projection point of the work vehicle 1 passes the inflection position CP, the posture of the vehicle body 2 may be changed so as to fall forward by the action of gravity until the specific part SP of the ground contact surface of the crawler belt 17 contacts the second surface F2. The specific part height Ha indicates a variation of a position of the specific part SP of the vehicle body 2 in the vertical direction, the variation being predicted when the posture of the vehicle body 2 falls forward after the center-of-gravity projection point of the work vehicle 1 passes the inflection position CP.

In the present embodiment, the specific part height calculation unit 103 starts calculation of the specific part height Ha when the idler wheels 16 of the work vehicle 1 moving forward on the first surface F1 pass the inflection position CP. The specific part height calculation unit 103 can determine whether or not the idler wheels 16 of the work vehicle 1 moving forward on the first surface F1 have passed the inflection position CP based on the vehicle data and the vehicle body position data detected by the position sensor 6.

The specific part height calculation unit 103 calculates the specific part height Ha based on the observed pitch angle PA of the vehicle body 2, which is detected by the inclination sensor 7 and acquired by the vehicle body angle acquisition unit 106, the target height of the cutting edge 19P, which is acquired by the target height acquisition unit 110, and the vehicle data acquired by the vehicle data acquisition unit 108.

In FIG. 6, the specific part height calculation unit 103 defines a virtual plane Fa that passes through the specific part SP and is parallel to the second surface F2. Moreover, the specific part height calculation unit 103 defines a virtual plane Fb that passes through the ground contact surface of the crawler belt 17 and is parallel to the ground contact surface of the crawler belt 17. The specific part height calculation unit 103 can define the virtual plane Fa based on the observed pitch angle PA detected by the inclination sensor 7. The specific part height calculation unit 103 can define the virtual plane Fb based on the vehicle data.

The specific part height calculation unit 103 calculates a vertical-direction distance H2 between the virtual plane Fa and the virtual plane Fb at a position passing through the cutting edge 19P in the local coordinate system.

The specific part height calculation unit 103 calculates a vertical-direction distance H3 between the virtual plane Fb and the line La that passes through the origin and extends in the longitudinal direction in the local coordinate system. The specific part height calculation unit 103 can calculate the distance H3 based on the vehicle data.

The distance H3 may be stored in a storage unit provided in the blade control device 10.

The specific part height calculation unit 103 acquires a target height Hr of the cutting edge 19P from the target height acquisition unit 110. The specific part height Ha is represented by [Hr−H3+H2]. As described above, the specific part height calculation unit 103 can calculate the specific part height Ha based on the observed pitch angle PA of the vehicle body 2, the target height Hr of the cutting edge 19P, and the vehicle data.

The corrected pitch angle calculation unit 111 corrects the observed pitch angle PA of the vehicle body 2 based on the specific part height Ha calculated by the specific part height calculation unit 103, and calculates a corrected pitch angle PAc of the vehicle body 2.

As mentioned above, the target height acquisition unit 110 acquires the target height of the cutting edge 19P from the target height calculation unit 34. The target height calculation unit 34 calculates the target height of the cutting edge 19P based on the vehicle body position data, the vehicle body angle data including the observed pitch angle PA, the vehicle data, the operation amount data, and the design surface data. For example, due to a data transmission delay or the like, a time lag may occur between the point of time when the inclination sensor 7 detects the observed pitch angle PA and the point of time when the vehicle body angle acquisition unit 105 acquires the observed pitch angle PA. When the time lag occurs, an error may occur between the observed pitch angle PA acquired by the vehicle body angle acquisition unit 105 and a true pitch angle PAr at the point of time when the vehicle body angle acquisition unit 105 acquires the observed pitch angle PA. The true pitch angle PAr is an actual pitch angle of the vehicle body 2. As described above, due to the time lag, the vehicle body angle acquisition unit 105 may acquire the observed pitch angle PA delayed from the true pitch angle PAr and showing a value different from the true pitch angle PAr.

In the present embodiment, the corrected pitch angle calculation unit 111 estimates the delay time of the observed pitch angle PA with respect to the true pitch angle PAr based on the specific part height Ha calculated by the specific part height calculation unit 103 and an estimation table stored in advance. The delay time of the observed pitch angle PA with respect to the true pitch angle PAr refers to a time lag between a point of time when the inclination sensor 7 detects the observed pitch angle PA and a point of time when the vehicle body angle acquisition unit 105 acquires the observed pitch angle data indicating the observed pitch angle PA.

Figure 7:
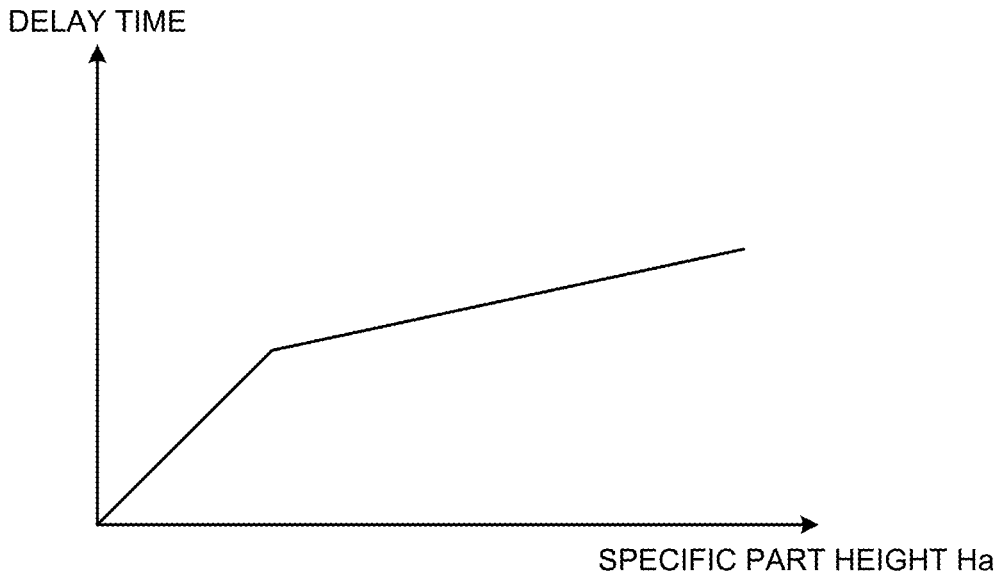
FIG. 7 is a diagram illustrating an estimation table according to the present embodiment.

FIG. 7 is a diagram illustrating the estimation table according to the present embodiment. The estimation table includes correlation data indicating a relationship between the specific part height Ha and the delay time of the observed pitch angle PA with respect to the true pitch angle PAr. The estimation table is predetermined by preliminary experiments or simulations and is stored in the corrected pitch angle calculation unit 111. As illustrated in FIG. 7, the delay time increases as the specific part height Ha is larger. The delay time decreases as the specific part height Ha is smaller.

The corrected pitch angle calculation unit 111 estimates the delay time of the observed pitch angle PA with respect to the true pitch angle PAr based on the specific part height Ha calculated by the specific part height calculation unit 103 and an estimation table as illustrated in FIG. 7.

The corrected pitch angle calculation unit 111 calculates an observed pitch angular velocity PAv of the vehicle body 2 based on a variation of the observed pitch angle PA per unit time. The corrected pitch angle calculation unit 111 calculates the observed pitch angular velocity PAv of the vehicle body 2 by differentiating the observed pitch angle PA.

The corrected pitch angle calculation unit 111 estimates the true pitch angle PAr based on the delay time and the observed pitch angular velocity PAv, and calculates the error between the true pitch angle PAr and the observed pitch angle PA. The corrected pitch angle calculation unit 111 calculates the corrected pitch angle PAc based on the error between the true pitch angle PAr and the observed pitch angle PA and based on the observed pitch angle PA. The corrected pitch angle PAc corresponds to the true pitch angle PAr.

Based on the corrected pitch angle PAc calculated by the corrected pitch angle calculation unit 111, the target height correction unit 112 corrects the target height of the cutting edge 19P, which is acquired by the target height acquisition unit 110, and generates a corrected target height of the cutting edge 19P of the blade 19. The corrected target height of the cutting edge 19P refers to a position of the cutting edge 19P, where the cutting edge 19P can be matched with the second surface F2 of the design surface IS in the local coordinate system.

As mentioned above, the target height calculation unit 34 calculates the target height of the cutting edge 19P based on the observed pitch angle data and the like. For example, due to a computation delay, the data transmission delay or the like, a time lag may occur between a point of time when the target height calculation unit 34 calculates the pitch rotation height based on the observed pitch angle data, a point of time when the target height calculation unit 34 calculates the target height of the cutting edge 19P based on the pitch rotation height, and a point of time when the target height acquisition unit 110 acquires the target height. When the time lag occurs, an error occurs between the target height of the cutting edge 19P, which is acquired by the target height acquisition unit 110, and a target height that should be truly referred to at the point of time when the target height acquisition unit 110 acquires the target height. As described above, due to the time lag, the target height acquisition unit 110 may acquire such a target height showing a value different from the target height that should be truly referred to, such a target height being delayed from the target height that should be truly referred to.

In the present embodiment, the target height correction unit 112 corrects the target height of the cutting edge 19P, which is acquired by the target height acquisition unit 110, based on the corrected pitch angle PAc corrected in consideration of the delay time, and generates the corrected target height that should be truly referred to. The corrected target height shows a value higher than the target height.

The target cylinder speed calculation unit 104 calculates a target cylinder speed of the lift cylinder 25, which adjusts the height of the cutting edge 19P of the blade 19, based on the corrected pitch angle PAc. The target cylinder speed calculation unit 104 calculates the target cylinder speed of the lift cylinder 25 based on the corrected target height calculated based on the corrected pitch angle PAc.

The target cylinder speed calculation unit 104 calculates the target cylinder speed so that a deviation between the height of the cutting edge 19P of the blade 19, which is calculated by the actual height calculation unit 109, and the corrected target height generated by the target height correction unit 112 becomes small.

The differentiation unit 115 calculates a corrected target height variation based on the corrected target height of the cutting edge 19P, which is generated by the target height correction unit 112.

The corrected cylinder speed calculation unit 113 calculates a target cylinder speed correction value based on the specific part height Ha and the corrected target height variation calculated by the differentiation unit 115.

In the present embodiment, the corrected cylinder speed calculation unit 113 calculates the target cylinder speed correction value based on the specific part height Ha calculated by the specific part height calculation unit 103 and based on a correction table stored in advance.

Figure 8:
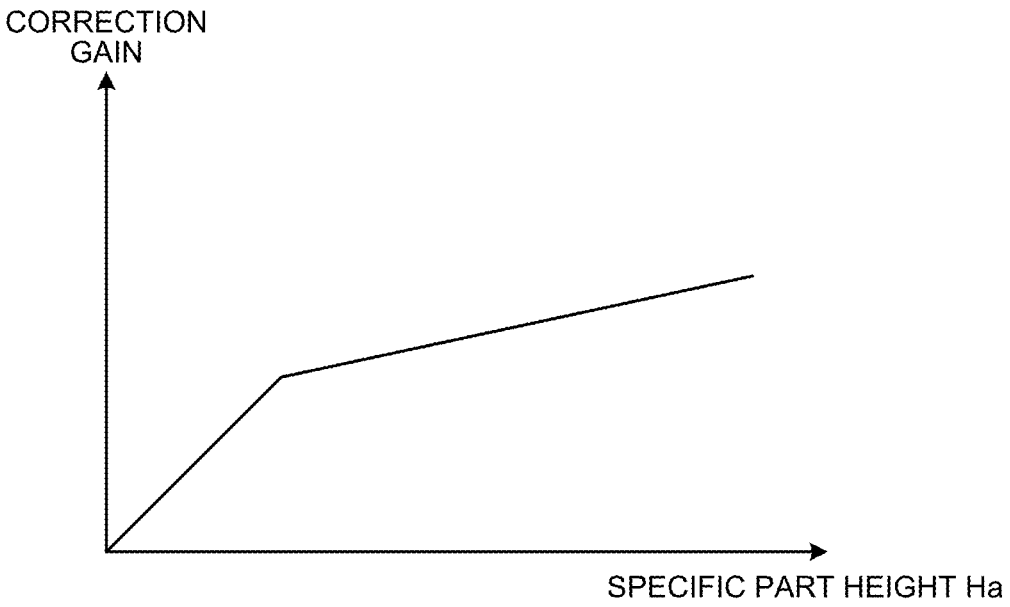
FIG. 8 is a diagram illustrating an estimation table according to the present embodiment.

FIG. 8 is a diagram illustrating the correction table according to the present embodiment. The correction table includes correlation data indicating a relationship between the specific part height Ha and a correction gain to be given to the corrected target height variation. The correction table is predetermined by preliminary experiments or simulations in consideration of a delay of a cylinder speed due to a hydraulic pressure, and is stored in the corrected cylinder speed calculation unit 113. As illustrated in FIG. 8, the correction gain increases as the specific part height Ha is larger. The correction gain decreases as the specific part height Ha is smaller.

Based on the specific part height Ha calculated by the specific part height calculation unit 103 and based on such a correction table as illustrated in FIG. 8, the corrected cylinder speed calculation unit 113 gives a correction gain, which corresponds to the specific part height Ha, to the corrected target height variation, and calculates the target cylinder speed correction value. The corrected cylinder speed shows a value higher than the target cylinder speed.

The addition unit 116 adds the target cylinder speed calculated by the target cylinder speed calculation unit 104 and the target cylinder speed correction value calculated by the corrected cylinder speed calculation unit 113 to each other, and calculates a corrected cylinder speed. The corrected cylinder speed shows a value higher than the target cylinder speed.

The lift cylinder 25 is hydraulically driven. Therefore, an actual cylinder speed of the lift cylinder 25 may be delayed with respect to the target cylinder speed. In order that the delay of the cylinder speed due to the hydraulic pressure is eliminated, the addition unit 116 corrects the target cylinder speed, and calculates the corrected cylinder speed.

Based on the corrected cylinder speed calculated by the addition unit 116, the control command output unit 114 outputs, to the control valve 28, a control command to control the height of the cutting edge 19P of the blade 19. The control command output from the control command output unit 114 is a control command to drive the lift cylinder 25 at the corrected cylinder speed. The control command output unit 114 outputs the control command to the control valve 28 so that the lift cylinder 25 is driven at the corrected cylinder speed. The control command output from the control command output unit 114 includes a current that controls the control valve 28.

[Blade Control Method]

Figure 9:
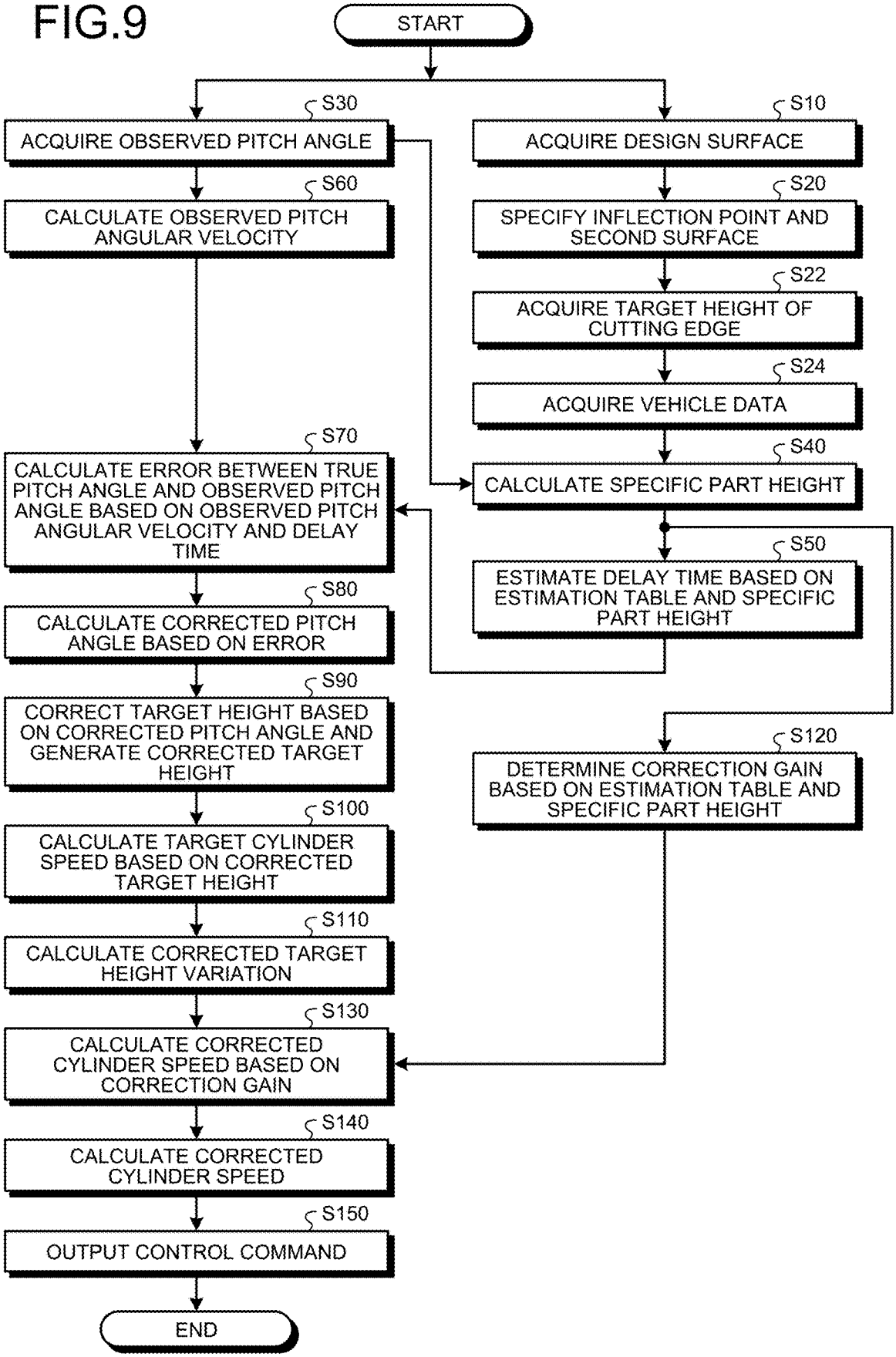
FIG. 9 is a flowchart illustrating a blade control method according to the present embodiment.

Next, a blade control method according to the present embodiment will be described. FIG. 9 is a flowchart illustrating the blade control method according to the present embodiment. Processing illustrated in FIG. 9 is performed in a specified cycle.

The design surface acquisition unit 101 acquires the design surface IS from the design surface data storage unit 31 (step S10). In the present embodiment, the design surface IS in a specified range in front of the work vehicle 1 (for example, 10 [m]) is transmitted from the target height generation device 30 to the blade control device 10 in a state in which the work vehicle 1 moves forward. The design surface acquisition unit 101 acquires the design surface IS in the specified range in front of the work vehicle 1 from the design surface data storage unit 31. In a specified cycle, the design surface acquisition unit 101 acquires the design surface IS in the specified range in front of the work vehicle 1, the specified range changing as the work vehicle 1 moves forward.

The inflection position search unit 102 specifies the inflection position CP indicating the front end portion of the first surface F1 in the design surface IS acquired by the design surface acquisition unit 101. Further, the inflection position search unit 102 specifies a position of the second surface F2 in the height direction and the observed pitch angle β thereof (step S20).

The target height acquisition unit 110 acquires the target height of the cutting edge 19P (step S22).

The vehicle data acquisition unit 108 acquires the vehicle data (step S24).

The vehicle body angle acquisition unit 106 acquires the vehicle body angle data including the observed pitch angle PA (step S30).

The specific part height calculation unit 103 calculates the specific part height Ha indicating the height-direction distance between the specific part SP of the ground contact surface of the work vehicle 1 and the second surface F2 based on the observed pitch angle PA, the target height of the cutting edge 19P, and the vehicle data of the vehicle body 2 in a state in which at least a part of the vehicle body 2 is positioned on the first surface F1 and the blade 19 is positioned above the second surface F2. (step S40).

The corrected pitch angle calculation unit 111 estimates the delay time of the observed pitch angle PA with respect to the true pitch angle PAr based on the specific part height Ha calculated by the specific part height calculation unit 103 and an estimation table stored in advance (step S50).

The corrected pitch angle calculation unit 111 differentiates the observed pitch angle PA, and calculates the observed pitch angular velocity PAv (step S60).

The corrected pitch angle calculation unit 111 calculates the error between the true pitch angle PAr and the observed pitch angle PA based on the observed pitch angular velocity PAv calculated in step S60 and the delay time estimated in step S50 (step S70). The corrected pitch angle calculation unit 111 calculates the true pitch angle PAr by multiplying the observed pitch angular velocity PAv and the delay time by each other, and calculates the error between the true pitch angle PAr and the observed pitch angle PA.

The corrected pitch angle calculation unit 111 calculates the corrected pitch angle PAc based on the error calculated in step S70 and the observed pitch angle PA (step S80). The corrected pitch angle calculation unit 111 calculates the corrected pitch angle PAc by adding the error calculated in step S70 to the observed pitch angle PA. The corrected pitch angle PAc corresponds to the true pitch angle PAr.

Based on the corrected pitch angle PAc calculated in step S80, the target height correction unit 112 corrects the target height of the cutting edge 19P, which is acquired by the target height acquisition unit 110, and generates the corrected target height (step S90). That is, in order that the cutting edge 19P matches the second surface F2 when the vehicle body 12 is inclined at the corrected pitch angle PAc, the target height correction unit 112 corrects the target height, and generates the corrected target height.

Based on the corrected target height, the target cylinder speed calculation unit 104 calculates the target cylinder speed for controlling the height of the blade 19 (step S100). The target cylinder speed calculation unit 104 calculates the target cylinder speed based on the corrected target height so that the cutting edge 19P matches the second surface F2.

The differentiation unit 115 calculates the corrected target height variation based on the corrected target height (step S110).

The corrected cylinder speed calculation unit 113 determines the correction gain for the target cylinder speed based on the correction table and the specific part height Ha (step S120).

The corrected cylinder speed calculation unit 113 calculates the target cylinder speed correction value based on the correction gain determined in step S120 (step S130). The corrected cylinder speed calculation unit 113 multiplies the correction gain determined in step S120 and the corrected target height variation calculated in step S110 by each other, and calculates the target cylinder speed correction value.

The addition unit 116 adds the target cylinder speed and the target cylinder speed correction value to each other, and calculates the corrected cylinder speed (step S140).

The control command output unit 114 generates the control command based on the corrected cylinder speed calculated in step S140, and outputs the generated control command to the control valve 28 (step S150).

[Functions]

Figure 10:
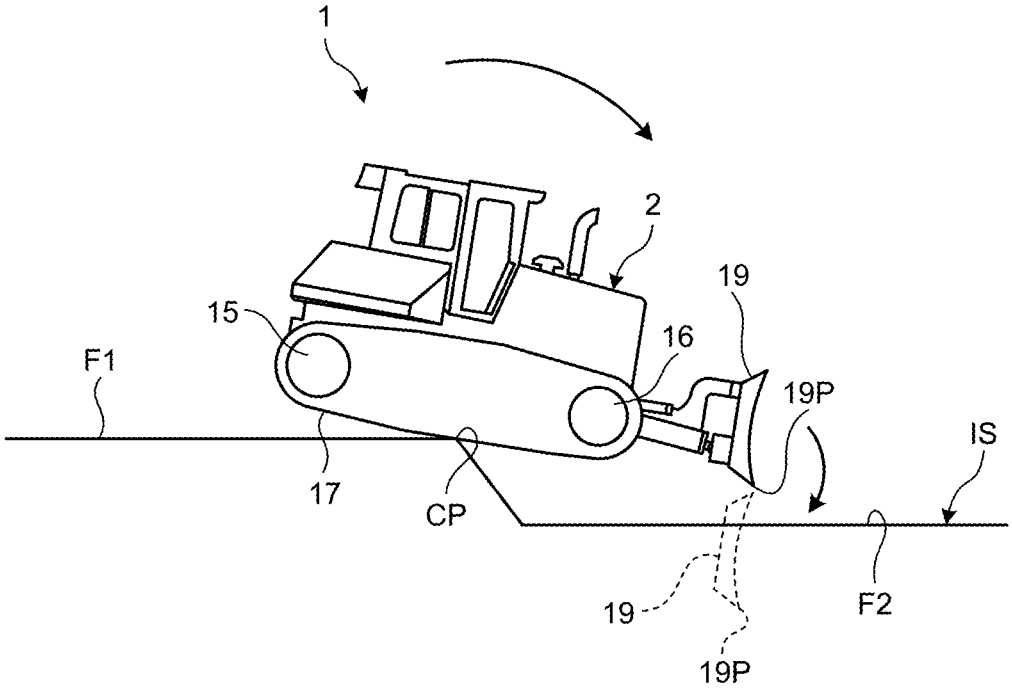
FIG. 10 is a view schematically illustrating an operation of a work vehicle according to a comparative example.

FIG. 10 is a view schematically illustrating an operation of a work vehicle 1 according to a comparative example. When the work vehicle 1 moves forward along the first surface F1 and the center-of-gravity projection point of the work vehicle 1 passes the inflection position CP, the posture of the vehicle body 2 may be changed so as to fall forward by the action of gravity until the specific part SP of the ground contact surface of the crawler belt 17 contacts the second surface F2. When the control delay of the blade 19 occurs when the vehicle body 2 falls forward, the blade 19 may fail to follow the design surface IS. Since the position and moving speed of the blade 19 are hydraulically controlled, the control delay may occur. Further, the control delay may occur, for example, due to various data transmission delays from the target height generation device 30 to the blade control device 10, various computation delays in the target height generation device 30, various computation delays in the blade control device 10, and the like. When the control delay of the blade 19 occurs, as illustrated in FIG. 10, the blade 19 excavates the excavation object in a state in which the cutting edge 19P goes below the second surface F2 of the design surface IS, and the excavation object may not be excavated into a desired shape.

Figure 11:
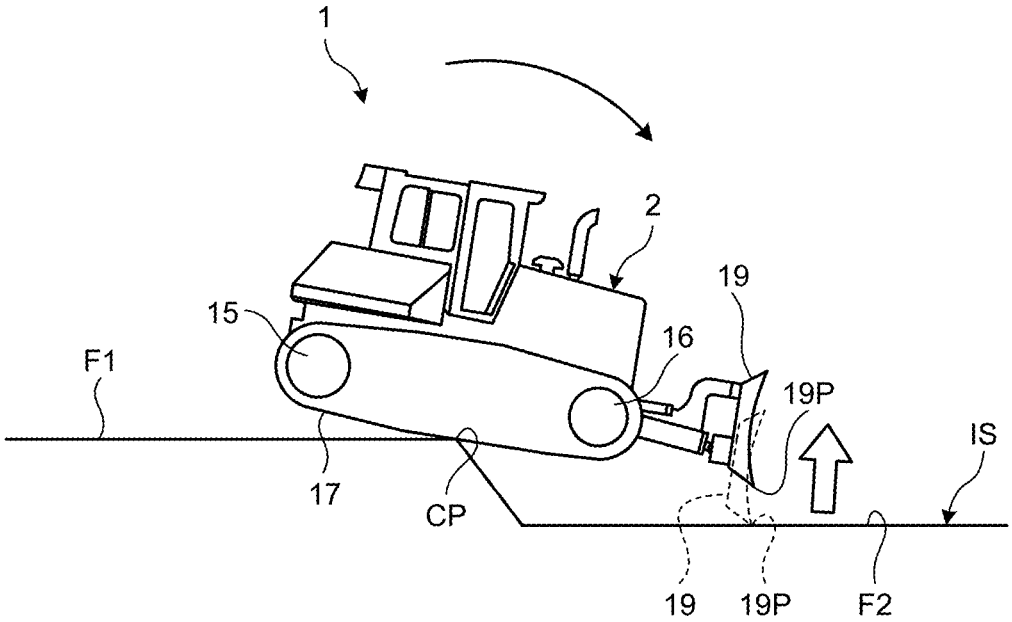
FIG. 11 is a diagram schematically illustrating an operation of the work vehicle according to the present embodiment.

FIG. 11 is a view schematically illustrating an operation of the work vehicle 1 according to the present embodiment. In the present embodiment, the specific part height Ha is calculated, the observed pitch angle PA is corrected based on the specific part height Ha, and the corrected pitch angle PAc is calculated. Even if there occurs the transmission delay of the observed pitch angle data from the target height generation device 30 to the blade control device 10, a delay time of the transmission of the observed pitch angle data is estimated based on the estimation table and the specific part height Ha. The delay time is estimated, whereby the corrected pitch angle calculation unit 111 can calculate the corrected pitch angle PAc corresponding to the true pitch angle PAr.

Moreover, even if there occurs the delay in computation of the target height of the cutting edge 19P by the target height calculation unit 34, and there occurs the delay in transmission of the target height data, which indicates the target height, from the target height generation device 30 to the blade control device 10, then based on the corrected pitch angle PAc, the target height correction unit 112 can correct the target height of the cutting edge 19P so as to eliminate such a computation delay or a transmission delay, and can generate the corrected target height.

The target cylinder speed calculation unit 104 calculates the target cylinder speed based on the corrected target height calculated so as to eliminate the control delay. The corrected target height is set to a position higher than the target height. Accordingly, even if the control delay of the blade 19 occurs, the blade 19 is controlled so that the cutting edge 19P follows the second surface F2, and the cutting edge 19P is inhibited from moving below the second surface F2. Hence, the excavation object is inhibited from being excavated deeply.

Since the blade 19 is hydraulically driven, the control delay due to hydraulic responsiveness may occur. In the present embodiment, the target cylinder speed is corrected based on the specific part height Ha, and the corrected cylinder speed is calculated. Even if the control delay due to the hydraulic response occurs, the corrected cylinder speed is calculated based on the correction table and the specific part height Ha so that the control delay due to the hydraulic pressure is eliminated. The corrected cylinder speed is set to a value higher than the target cylinder speed. Accordingly, even if the control delay of the blade 19 occurs, the blade 19 is controlled so that the cutting edge 19P follows the second surface F2, and the cutting edge 19P is inhibited from moving below the second surface F2. Hence, the excavation object is inhibited from being excavated deeply.

[Computer System]

Figure 12:
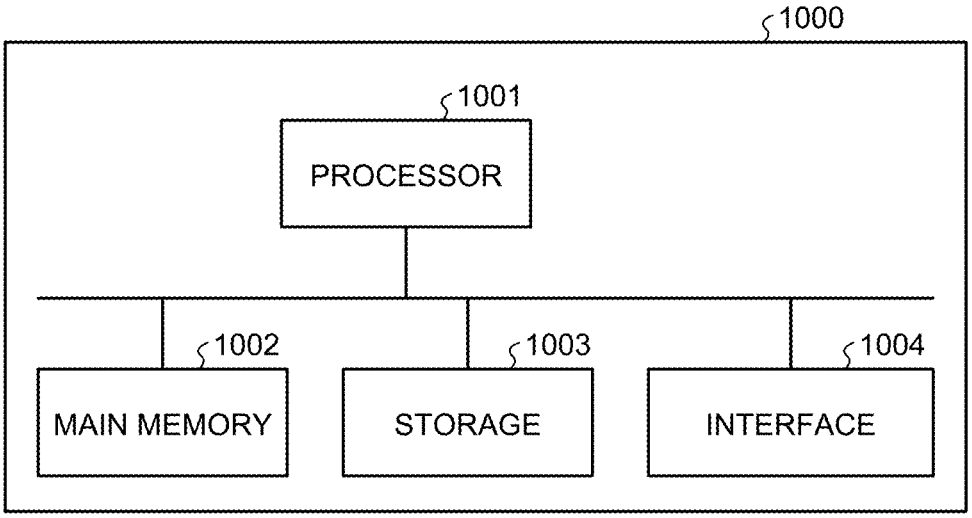
FIG. 12 is a block diagram illustrating a computer system according to the present embodiment.

FIG. 12 is a block diagram illustrating a computer system 1000 according to the present embodiment. Each of the above-mentioned blade control device 10 and target height generation device 30 includes the computer system 1000. The computer system 1000 includes a processor 1001 such as a central processing unit (CPU), a main memory 1002 including a nonvolatile memory such as a read only memory (ROM) and a volatile memory such as a random access memory (RAM), a storage 1003, and an interface 1004 including an input/output circuit. Functions of the above-mentioned blade control device 10 and functions of the above-mentioned target height generation device 30 are stored as a program in the storage 1003. The processor 1001 reads the program from the storage 1003, expands the program in the main memory 1002, and executes the above-mentioned processing according to the program. The program may be delivered to the computer system 1000 via a network.

[Effects]

As described above, according to the present embodiment, the corrected pitching angle PAc is calculated based on the specific part height Ha, and the target cylinder speed of the lift cylinder 25 that adjusts the height of the blade 19 based on the corrected pitch angle PAc is calculated. Thus, the blade 19 is controlled so that the cutting edge 19P follows the design surface IS even in a situation where the data transmission delay or the computation delay may occur. Hence, the excavation object is inhibited from being excavated deeply, and the excavation object is excavated into a desired shape.

Moreover, in the present embodiment, the target cylinder speed is corrected based on the specific part height Ha to calculate the corrected cylinder speed, and the control command is output so that the lift cylinder 25 is driven at the corrected cylinder speed. Thus, the blade 19 is controlled so that the cutting edge 19P follows the design surface IS even in a situation where the control delay due to the hydraulic pressure may occur. Hence, the excavation object is inhibited from being excavated deeply, and the excavation object is excavated into a desired shape.

[Other Embodiments]

In the above-mentioned embodiment, the example in which the work vehicle 1 is a bulldozer has been described. The work vehicle 1 may be a motor grader having a blade.

REFERENCE SIGNS LIST

1 WORK VEHICLE
2 VEHICLE BODY
3 TRAVEL DEVICE
4 WORKING EQUIPMENT
5 HYDRAULIC CYLINDER
6 POSITION SENSOR
7 INCLINATION SENSOR
8 SPEED SENSOR
9 OPERATION AMOUNT SENSOR
10 BLADE CONTROL DEVICE
11 OPERATOR'S CAB
12 ENGINE COMPARTMENT
13 SEAT
14 OPERATION DEVICE
15 DRIVE WHEEL
16 IDLER WHEEL
17 CRAWLER BELT
18 LIFT FRAME
19 BLADE
19P CUTTING EDGE
20 BALL JOINT PORTION
21 PITCH SUPPORT LINK
22 SUPPORT PORTION
23 UNIVERSAL JOINT
24 PITCHING JOINT
25 LIFT CYLINDER
26 ANGLE CYLINDER
27 TILT CYLINDER
28 CONTROL VALVE
30 TARGET HEIGHT GENERATION DEVICE
31 DESIGN SURFACE DATA STORAGE UNIT
32 VEHICLE DATA STORAGE UNIT
33 DATA ACQUISITION UNIT
34 TARGET HEIGHT CALCULATION UNIT
101 DESIGN SURFACE ACQUISITION UNIT
102 INFLECTION POSITION SEARCH UNIT
103 SPECIFIC PART HEIGHT CALCULATION UNIT
104 TARGET CYLINDER SPEED CALCULATION UNIT
105 VEHICLE BODY POSITION ACQUISITION UNIT
106 VEHICLE BODY ANGLE ACQUISITION UNIT
107 OPERATION AMOUNT ACQUISITION UNIT
108 VEHICLE DATA ACQUISITION UNIT
109 ACTUAL HEIGHT CALCULATION UNIT
110 TARGET HEIGHT ACQUISITION UNIT
111 CORRECTED PITCH ANGLE CALCULATION UNIT
112 TARGET HEIGHT CORRECTION UNIT
113 CORRECTED CYLINDER SPEED CALCULATION UNIT
114 CONTROL COMMAND OUTPUT UNIT
AX ROTATION AXIS
BX ROTATION AXIS
CX ROTATION AXIS
F1 FIRST SURFACE
F2 SECOND SURFACE
IS DESIGN SURFACE
L STROKE LENGTH
PA OBSERVED PITCH ANGLE
α INCLINATION ANGLE
β INCLINATION ANGLE (DESIGN SURFACE PITCH ANGLE)
θ LIFT ANGLE

The invention claimed is:

1. A blade control device comprising:

a processor configured with the following components:

a design surface acquisition unit that acquires a design surface indicating a target shape of an excavation object to be excavated by a blade supported by a vehicle body of a work vehicle, the design surface including a first surface present in front of the work vehicle and a second surface disposed below the first surface and forming a level difference with a front end portion of the first surface;

a vehicle body angle acquisition unit that acquires an observed pitch angle indicating an inclination angle of the vehicle body in a longitudinal direction;

a specific part height calculation unit that, in a state in which at least a part of the vehicle body is positioned on the first surface and the blade is positioned above the second surface, calculates a specific part height indicating a height-direction distance between a specific part of the work vehicle and the second surface;

a corrected pitch angle calculation unit that corrects the observed pitch angle based on the specific part height and calculates a corrected pitch angle of the vehicle body; and a target cylinder speed calculation unit that, based on the corrected pitch angle, calculates a target cylinder speed of a hydraulic cylinder that adjusts a height of the blade.

2. The blade control device according to claim 1, further comprising as a component of the processor:

an inflection position search unit that searches for an inflection position indicating the front end portion of the first surface on the design surface, wherein the specific part height calculation unit calculates the specific part height based on the inflection position.

3. The blade control device according to claim 1, further comprising as components of the processor:

a vehicle body position acquisition unit that acquires a position of the vehicle body;

an operation amount acquisition unit that acquires an operation amount of the hydraulic cylinder;

an actual height calculation unit that calculates the height of the blade based on the position of the vehicle body, the inclination angle of the vehicle body, and the operation amount of the hydraulic cylinder;

a target height acquisition unit that acquires a target height of the blade, the target height being calculated based on the design surface; and a target height correction unit that corrects the target height based on the corrected pitch angle, and generates a corrected target height, wherein the target cylinder speed calculation unit calculates the target cylinder speed such that a deviation between a height of a cutting edge of the blade and the corrected target height becomes small.

4. The blade control device according to claim 3, wherein the target cylinder speed calculation unit calculates the target cylinder speed based on the corrected target height, and the blade control device processor further comprises:

a differentiation unit that calculates a corrected target height variation based on the corrected target height;

a corrected cylinder speed calculation unit that calculates a target cylinder speed correction value based on the specific part height and the corrected target height variation;

an addition unit that adds the target cylinder speed and the target cylinder speed correction value to each other and calculates a corrected cylinder speed; and a control command output unit that outputs a control command to control the height of the blade based on the corrected cylinder speed.

5. The blade control device according to claim 1, wherein the work vehicle includes a front wheel, a rear wheel, and a crawler belt supported by the front wheel and the rear wheel, and the specific part includes a front portion of a ground contact surface of the crawler belt.

6. A blade control method comprising:

providing a processor configured to perform the following:

acquiring a design surface indicating a target shape of an excavation object to be excavated by a blade supported by a vehicle body of a work vehicle, the design surface including a first surface present in front of the work vehicle and a second surface disposed below the first surface and forming a level difference with a front end portion of the first surface;

acquiring an observed pitch angle indicating an inclination angle of the vehicle body in a longitudinal direction; and calculating a specific part height indicating a height-direction distance between a specific part of the work vehicle and the second surface in a state in which at least a part of the vehicle body is positioned on the first surface and the blade is positioned above the second surface.

7. A work vehicle comprising a vehicle body supporting a blade and a blade control device, the blade control device comprising:

a processor configured to perform the following:

acquiring a design surface indicating a target shape of an excavation object to be excavated by the blade supported by the vehicle body of the work vehicle, the design surface including a first surface present in front of the work vehicle and a second surface disposed below the first surface and forming a level difference with a front end portion of the first surface;

acquiring an observed pitch angle indicating an inclination angle of the vehicle body in a longitudinal direction;

in a state in which at least a part of the vehicle body is positioned on the first surface and the blade is positioned above the second surface, calculating a specific part height indicating a height-direction distance between a specific part of the work vehicle and the second surface;

correcting the observed pitch angle based on the specific part height and calculating a corrected pitch angle of the vehicle body; and based on the corrected pitch angle, calculating a target cylinder speed of a hydraulic cylinder that adjusts a height of the blade.

* * * * *